US009319793B2

(12) United States Patent
Braho

(10) Patent No.: US 9,319,793 B2
(45) **Date of Patent: *Apr. 19, 2016**

(54) HEADSET SIGNAL MULTIPLEXING SYSTEM AND METHOD

(71) Applicant: Vocollect, Inc., Pittsburgh, PA (US)
(72) Inventor: Keith Braho, Murrysville, PA (US)
(73) Assignee: Vocollect, Inc., Pittsburgh, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/467,405
(22) Filed: Aug. 25, 2014
(65) Prior Publication Data
US 2014/0363015 A1 Dec. 11, 2014

Related U.S. Application Data
(63) Continuation of application No. 13/159,988, filed on Jun. 14, 2011, now Pat. No. 8,824,696.

(51) Int. Cl.
*H04R 1/10* (2006.01)
*H04R 3/12* (2006.01)
*H04R 3/00* (2006.01)

(52) U.S. Cl.
CPC .. *H04R 3/12* (2013.01); *H04R 1/10* (2013.01); *H04R 2201/107* (2013.01); *H04R 2420/07* (2013.01)

(58) Field of Classification Search
CPC ..... H04R 3/12; H04R 1/10; H04R 2201/107; H04R 2420/07
USPC ..... 381/74, 71.6, 120, 77, 92; 455/575.2, 455/517, 7, 8, 9, 11.1, 25
See application file for complete search history.

(56) References Cited

U.S. PATENT DOCUMENTS 4,418,411 A * 11/1983 Strietzel ..... G01S 13/78 340/870.16
5,732,143 A * 3/1998 Andrea ..... G10K 11/178 381/71.13

(Continued)

FOREIGN PATENT DOCUMENTS

WO 2005109950 A1 11/2005
WO 2010105255 A2 9/2010

OTHER PUBLICATIONS

Extended EP Search Report, Application No. 12801061.8, Dated Dec. 12, 2014, 6 pages. Only Art not previously cited has been documented above.

(Continued)

*Primary Examiner* — Vivian Chin
*Assistant Examiner* — Ammar Hamid
(74) *Attorney, Agent, or Firm* — Additon, Higgins & Pendleton, P.A.

(57) ABSTRACT

A system and method for supplying power to a headset, and for transmitting multiple signals generated in the headset to a terminal using frequency division multiplexing. An audio signal and a carrier signal are generated in the terminal and summed together to form a composite uplink signal. The composite uplink signal is provided to a headset over a first physical channel. At the headset, the audio and carrier signals are separated, and the carrier signal is used to generate power in the headset. Signals generated by a plurality of acoustic sensors in the headset are combined using frequency division multiplexing to generate a composite downlink signal, which is transmitted to the terminal over a second physical channel. One or more carrier signals used to generate the composite downlink signal are provided by either a carrier source in the headset, or by recovering the carrier signal from the composite uplink signal.

20 Claims, 5 Drawing Sheets

(56) References Cited

U.S. PATENT DOCUMENTS

| | | | | |
|---|---|---|---|---|
| 7,099,481 | B2 | 8/2006 | Baker et al. | |
| 7,450,726 | B2 | 11/2008 | Goyal | |
| 7,706,821 | B2 * | 4/2010 | Konchitsky | H04R 3/00 455/114.2 |
| 7,734,361 | B2 | 6/2010 | Murawski et al. | |
| 8,014,539 | B2 | 9/2011 | Song et al. | |
| 2001/0000313 | A1 * | 4/2001 | Zhang | H04H 20/88 381/7 |
| 2001/0053228 | A1 * | 12/2001 | Jones | G10K 11/1788 381/71.6 |
| 2007/0281760 | A1 * | 12/2007 | Nikitin | H04B 1/385 455/575.2 |
| 2010/0081487 | A1 | 4/2010 | Chen et al. | |
| 2012/0177213 | A1 | 7/2012 | Le Faucheur | |

OTHER PUBLICATIONS

Japanese Office Action, PCT/US2012/042435, Dated May 22, 2014, 4 pages, English Translation provided.

International Search Report for PCT/US12/42435; dated Oct. 26, 2012; 4 pages.

* cited by examiner

HEADSET SIGNAL MULTIPLEXING SYSTEM AND METHOD

CROSS-REFERENCE TO RELATED APPLICATIONS

The present application claims the benefit of U.S. patent application Ser. No. 13/159,988 for a Headset Signal Multiplexing System and Method filed Jun. 14, 2011 (and published Dec. 20, 2012 as U.S. Patent Application Publication No. 2012/0321097), now U.S. Pat. No. 8,824,696. International Application No. PCT/US12/42435 for a *Headset Signal Multiplexing System and Method* filed Jun. 14, 2012 (and published Dec. 20, 2012 as WIPO Publication No. WO 2012/174226) also claims the benefit of U.S. patent application Ser. No. 13/159,988. Each of the foregoing patent applications, patent publications, and patent is hereby incorporated by reference in its entirety.

FIELD OF THE INVENTION

The present invention relates generally to systems and methods for handling multiple signals in a headset, and particularly to systems and methods of handing such signals over standard TRS type interconnections.

BACKGROUND

Headsets are often employed for a variety of purposes, such as to provide voice communications in a voice-directed or voice-assisted work environment. Such environments often use speech recognition technology to facilitate work, allowing workers to keep their hands and eyes free to perform tasks while maintaining communication with a voice-directed portable computer device or larger system. A headset for such applications typically includes a microphone positioned to pick up the voice of the wearer, and one or more speakers—or earphones—positioned near the wearer's ears so that the wearer may hear audio associated with the headset usage. Headsets may be coupled to a mobile or portable communication device—or terminal—that provides a link with other mobile devices or a centralized system, allowing the user to maintain communications while they move about freely.

Headsets often include a multi-conductor cable terminated by an audio plug that allows the headset to be easily connected to, and disconnected from, the terminal by inserting or removing the audio plug from a matching spring loaded audio socket. Standard audio plugs are typically comprised of a sectioned conductive cylinder, with each section electrically isolated from the other sections so that the plug provides multiple axially adjacent contacts. The end section is commonly referred to as a "tip", while the section farthest from the tip is referred to as a "sleeve". Additional sections located between the tip and sleeve are known as "ring" sections. An audio plug having three contacts is commonly referred to as a TRS (Tip Ring Sleeve) plug or jack. Standard audio plugs are also commonly available with two contacts (Tip Sleeve, or TS) and four contacts (Tip Ring Ring Sleeve, or TRRS), although larger numbers of rings are sometimes used. Standard diameters for TRS type plugs are 6.35 mm, 3.5 mm or 2.5 mm, and the connectors also typically have standard lengths and ring placements so that different headsets may be used interchangeably with multiple types of terminals.

As communications systems have evolved, headsets and the terminals to which they are coupled have become more complex, creating a need to transmit more signals between the headset and the terminal. For example, headsets used in work environments in voice-directed or voice-assisted applications are often subject to high ambient noise levels, such as those encountered in factories, warehouses or other worksites. High ambient noise levels may be picked up by the headset microphone, masking and distorting the speech of the headset wearer so that it becomes difficult for other listeners to understand or for speech recognition systems to process the audio signals from the microphone. One method of reducing the impact of ambient noise on speech signal quality is to include multiple microphones in the headset so that ambient noise may be separately detected and subtracted from desired voice audio by signal processing electronics and/or processors in the terminal. However, adding additional microphones to the headset creates a need to transport additional signals to the terminal, and may also require the addition of processing electronics to the headset. As more functionality is added, the associated electronic circuitry also creates a need for power in the headset.

One way to couple additional signals from—as well as provide power to—the headset is to simply add additional conductors and connector contacts. However, doing so requires changes in both headset and terminal hardware, creating compatibility issues so that new headsets and terminals cannot be used with older legacy equipment to provide even original levels of functionality. This hardware incompatibility may increase the total number of terminals and headsets which must be purchased, maintained and tracked in order to insure that each worker has a functioning terminal-headset pair. In addition, as the number of separate conductors increases, the size and cost of cables and connectors also undesirably increases.

Adding batteries and moving audio processing electronics from the terminal to the headset could also reduce the need for additional conductors in some applications, but would undesirably add cost, weight and complexity to the headset. Because headsets in work environments are typically assigned to an individual worker for hygiene purposes, while terminals are shared among workers, such as between shifts, a workplace communications system typically requires more headsets than terminals. Shifting cost and complexity from the terminal into the headset is therefore undesirable, since it may result in a significant increase in the total cost of purchasing and maintaining the communications system.

Therefore, there is a need for improved methods and systems for transmitting multiple signals between headsets and terminals using existing hardware interfaces, and that are compatible with existing headsets. Further, there is a need to couple power from the terminal to the headset over existing standard connector and cable interfaces in order to support increased functionality in newer headsets.

BRIEF DESCRIPTION OF THE DRAWINGS

The accompanying drawings, which are incorporated in and constitute a part of this specification, illustrate embodiments of the invention and, together with a general description of the invention given below, serve to explain the principles of the invention.

SUMMARY

Figure 1:
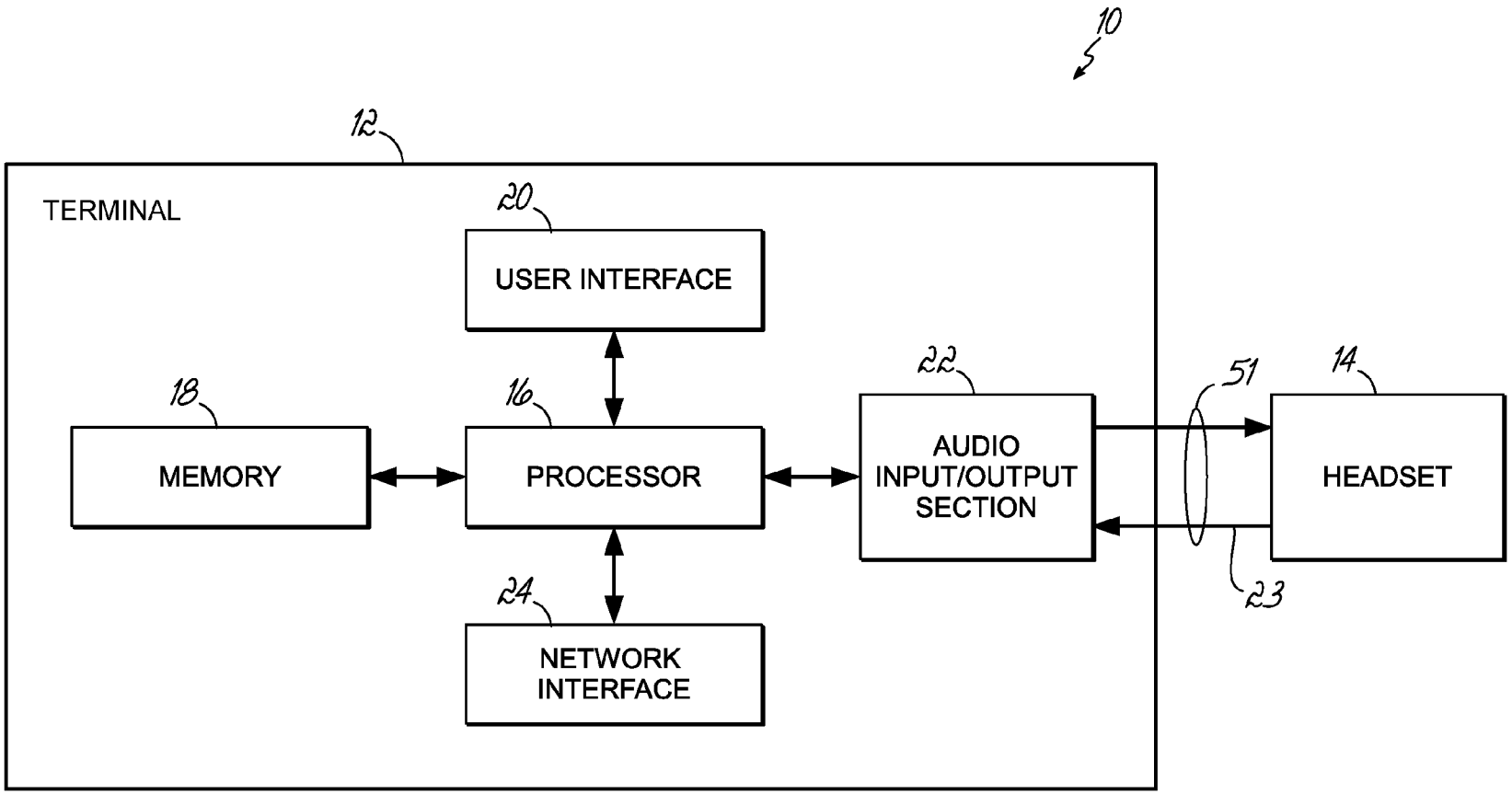
FIG. 1 is a block diagram illustrating a terminal and headset combination.

In one embodiment, a headset is provided that includes first and second acoustic sensors with each sensor having an output signal. A modulator in the headset is configured to receive a carrier signal and the output signal of the second acoustic sensor. The modulator is configured for modulating the carrier signal with the output signal of the second acoustic sensor, and provides a modulated output signal reflective of the output signal of the second acoustic sensor. Signal combining circuitry, such as a multiplexer, in the headset is coupled to the modulator and receives the output signal of the first acoustic sensor and the modulated output signal of the modulator. The signal combining circuitry combines the modulated output signal and the output signal of the first acoustic sensor to produce a composite downlink signal for transmission over a common conductor. First and second electrical connections in the headset are configured for providing a connection to a terminal device. The first electrical connection is configured for handling a carrier signal provided to the headset by the terminal device connected to the headset. The second electrical connection is coupled with the multiplexer for handling the composite downlink signal and directing the composite downlink signal to the terminal device.

In accordance with another embodiment, the carrier signal used by the modulator is provided by a composite uplink signal that includes both the carrier signal and an audio signal. The carrier signal and the audio signal are provided to the headset by a terminal over a common conductor between the headset and the terminal.

In accordance with yet another embodiment, power is provided to the headset by converting a portion of the carrier signal embedded in the composite uplink signal into a power supply voltage in the headset.

In accordance with still another embodiment, a second carrier signal is generated in the headset and modulated by the output of the second sensor. The modulated second carrier signal is combined with the output of the first sensor to produce a composite downlink signal for transmission over a common conductor.

DETAILED DESCRIPTION

A device uses frequency division multiplexing to combine a carrier signal with an audio signal, and outputs the resulting composite signal on a common physical channel connecting the device to a headset. In the headset, the carrier and audio signals are separated and the audio signal is provided to an acoustic actuator so that the headset wearer can hear the audio. The carrier signal may be used to provide power to the headset and/or to facilitate frequency division multiplexing of multiple microphone signals for transmission back to the device on a single physical downlink channel. In this way, multiple power and audio signals may share common conductors, allowing power to be delivered to the headset and multiple microphone signals to be transmitted to the device without modifications to existing device hardware, audio drivers, or connectors to gain the benefit of obtaining an additional microphone signal in the device, and without making legacy headsets obsolete. In one embodiment of the invention as disclosed, the device coupled to the headset is a computer terminal device. However, the invention might be used with other devices that may be utilized with headsets.

With reference to FIG. 1, a block diagram is presented illustrating a communication system 10 including a computer device, or "terminal", 12 coupled to a headset 14. The terminal 12 includes a processor 16 operatively coupled to a memory 18, a user interface 20, an audio input/output (audio I/O) section 22, and optionally, a network interface 24. The processor 16 may be a microprocessor, micro-controller, digital signal processor (DSP), microcomputer, central processing unit, field programmable gate array, programmable logic device, or any other device suitable for manipulating signals based on operational instructions that are stored in the processor 16 or in memory 18.

Memory 18 may be a single memory device or a plurality of memory devices including but not limited to read-only memory (ROM), random access memory (RAM), volatile memory, non-volatile memory, static random access memory (SRAM), dynamic random access memory (DRAM), flash memory, cache memory, and/or any other device capable of storing digital information. All or part of the memory 18 for system 10 may also be integrated into the processor 16 as noted.

The user interface 20 provides a mechanism by which a user may interact with the terminal 12 by accepting commands or other user input and transmitting the received input to the processor 16. The user interface 20 may include a keypad, touch screen, buttons, a dial or other method for entering data, such as by voice recognition of commands received through the audio I/O section 22 and forwarded to the user interface 20 by the processor 16. The user interface 20 may also include one or more displays to inform the user of the terminal 12 operational status, or any other operational parameter. User interface 20 may also include a voice processing capability such as for use with headset 14 in receiving speech commands. The voice processing capability may also allow the user interface 20 to provide audio or speech outputs to inform the user though voice or audio signals or tones transmitted through the processor 16 and audio I/O section 22 to the headset 14, where they may be heard by the user.

The audio I/O section 22 provides an interface between the processor 16 and the headset 14 that enables the terminal 12 to receive audio signals from the headset 14 and transmit audio signals to the headset 14. The audio I/O section 16 is adapted to receive one or more audio signals 23 from the headset 14, and convert the one or more received audio signals—which may be in analog form—into a digital signal suitable for manipulation by the processor 16. The audio I/O section 22 also converts the digital output signals provided by the processor into a form suitable for driving the headset 14. The audio I/O section 22 may include amplification stages and suitable coder/decoder (CODEC) circuitry in order to provide processing of audio signals suitable for use the headset 14. Although shown as a separate block in FIG. 1, some or all of the functions of the audio I/O section 22, particularly those associated with analog to digital and/or digital to analog signal conversion, may be integrated into the processor 16. In one embodiment, the terminal 12 implements speech recognition and text-to-speech (TTS) functionality through headset 14.

The network interface 24, if present, provides a communications link between the terminal 12 and other communication devices and/or central computer systems (not shown). The network interface 24 may include a wireless local access network (WLAN) transceiver to provide a wireless link to a local network using a standard wireless networking technology, such as IEEE 802.11 (Wi-Fi), IEEE 802.15.1 (Bluetooth), IEEE 802.15.4 (including ZigBee, WirelessHART, and MiWi) or any other suitable wireless networking technology.

Although FIG. 1 schematically illustrates one possible device 12 for implementing the invention, it is not limiting with respect to how the components might be arranged or otherwise organized. In accordance with one embodiment of the invention, a MC9090 Handheld Mobile Computer from Motorola of Schaumburg, Ill. might be used to implement the invention. Mobile phones or common personal computers, such as laptop computers or Tablet computers may also be used to implement the invention.

Figure 2A:
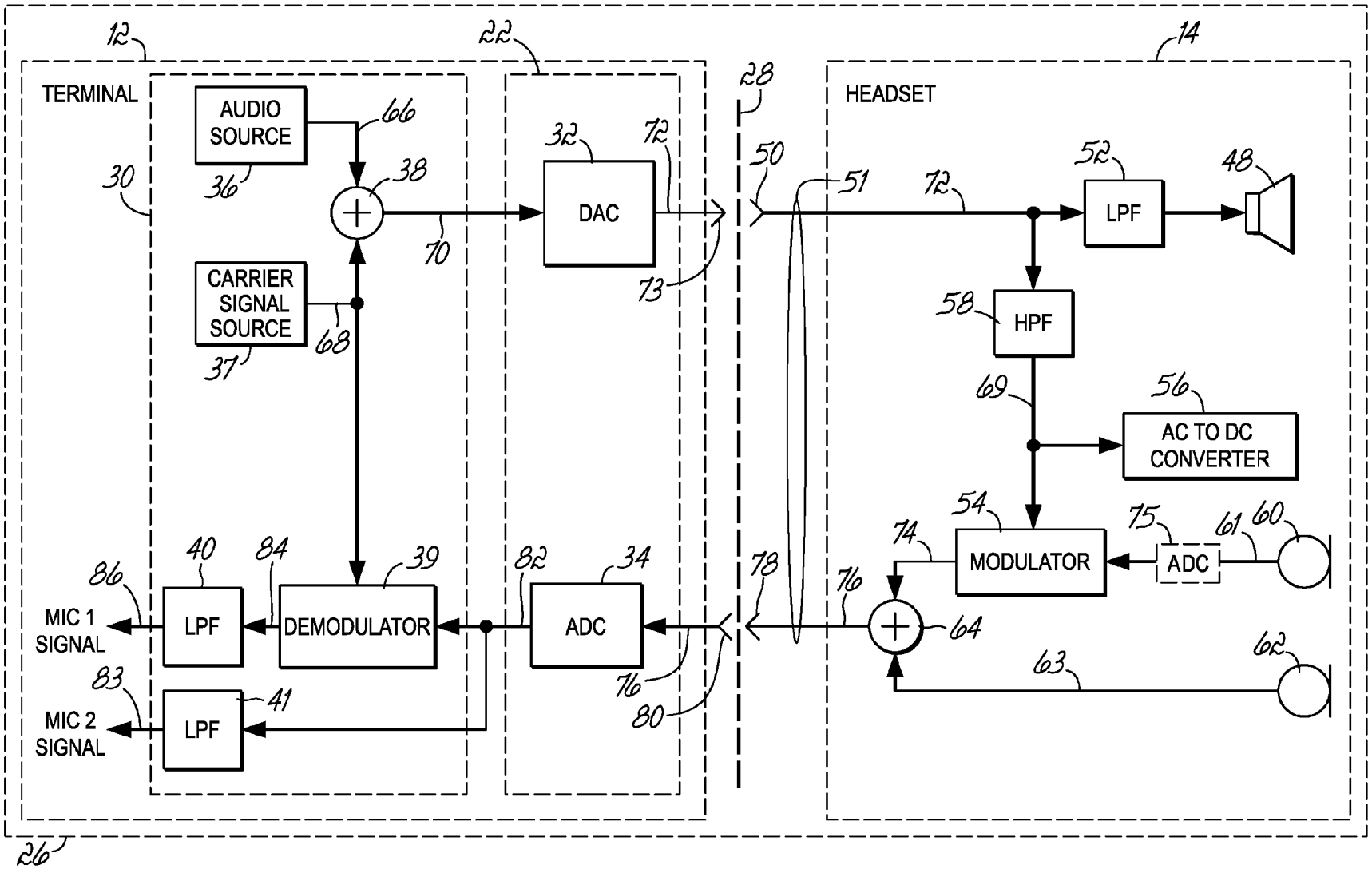
FIG. 2A is a block diagram showing a terminal and headset including a carrier source as well as power and signal multiplexing schemes in accordance with an embodiment of the invention.

With reference to FIG. 2A, and in accordance with an embodiment of the invention, a block diagram is presented illustrating a headset/terminal system 26 for implementing the invention. The system 26 includes a terminal 12, headset 14, and a connector interface 28, which may be a multi-contact plug and socket TRS type connection. As will be described in detail below, the system 26 provides a mechanism by which multiple signals may be communicated between the headset 14 and terminal 12, as well as a mechanism for providing power to the headset 14 from the terminal 12 over the connector interface 28. The headset implements a cable 51 having multiple conductors for handling the signals between the headset 14 and terminal 12. In a typical TRS connection scenario, the headset cable may have 3 conductors, or for TRRS, four conductors for handling the signals.

As shown in FIG. 2A, terminal 12 includes a signal processing and synthesis (SPS) section 30; and the audio I/O section 22, which includes a Digital to Analog Converter (DAC) 32, and an Analog to Digital Converter (ADC) 34. The SPS section 30 includes an audio source 36, a carrier signal source 37, a summing circuit 38, a demodulator 39, and low pass filters 40, 41. In an embodiment of the invention, the SPS section 30 functional blocks 36-41 may be implemented in software such as application level software or audio drivers running on the processor 16 based on operational instructions stored in memory 18. Advantageously, because the SPS section 30 functional blocks may be implemented by simply modifying terminal software, the headset/terminal system 26 can be implemented without significant hardware changes on the terminal side. Embodiments of the invention may therefore allow the use of existing terminal hardware by merely updating the terminal software, thus avoiding costly changes to the terminal hardware, audio drivers, and/or audio connectors.

Headset 14 includes an acoustic actuator, or earphone speaker 48 electrically coupled to a headset input 50 by a low pass filter 52. Headset 14 also includes a modulator 54, and an AC to DC converter 56, both electrically coupled to the headset input 50 by one or more high pass filters 58. A first acoustic sensor 60 is electrically coupled to the modulator 54 for capturing one source of acoustic signals, and a second acoustic sensor 62 is provided to capture an additional source of acoustic signals. The sources of acoustic signals may include user speech and/or background noise, either alone or in combination, such as may be contained in acoustic signals picked up at different locations. The acoustic sensors 60, 62 may be microphone elements. The outputs of the modulator 54 and the second acoustic sensor 62 are electrically coupled to appropriate signal combining circuitry, such as a multiplexer circuit 64, so that both signals may be multiplexed onto a headset output 78. While a multiplexer is discussed herein for combination of the various signals, other signal combining circuitry might also be implemented. In one embodiment of the invention, the multiplexer circuit 64 is configured to provide frequency division multiplexing.

Audio that is desired to be provided to a headset wearer through speaker 48 is introduced into the system 26 by the audio source 36. The audio source 36 generates an audio source signal 66, which may include audio originating from a recording, a text-to-speech (TTS) synthesis function, audio received from a communications system to which the terminal 12 is operatively connected, and/or any other audio signal to be communicated to the headset wearer, such as a tone or other audio information generated by the user interface 20. The carrier signal source 37 generates a carrier uplink signal 68, which may be, for example, a sinusoidal signal having a frequency above the highest desired frequency present in the audio source signal 66 so that frequency bands of the uplink carrier signal 68 and audio source signal 66 do not overlap. The audio source signal 66 and carrier uplink signal 68 are multiplexed by summing circuit 38 to form a composite uplink signal 70, which is provided to the DAC 32. The DAC 32 converts the composite uplink signal 70 into an analog composite uplink signal 72.

To avoid distorting the analog composite uplink signal 72, the amplitude of one or both of the audio source signal 66 and/or the carrier signal 68 may need to be adjusted so that the combined signal fits within the maximum analog and digital limits of the DAC 32 and associated circuitry. By keeping the amplitude of the composite uplink signal 70 within the maximum limits of the DAC 32 and associated circuitry, the output of the DAC 32 may be kept within its maximum allowable voltage range so that so that the analog composite uplink signal 72 is not dipped. The composite uplink signal 72 is then coupled from one or more terminal output contacts 73 to the headset input 50 through an appropriate connector interface 28. Generally, the composite uplink signal 72 is directed to the headset 14 using the appropriate contact and conductor dedicated to directing the audio source signal 66 to the headset 14 so that only a single conductor is implemented for both the audio source signal 66 and multiplexed carrier uplink signal 68.

In the headset 14, the audio source signal 66 is recovered or separated from the composite uplink signal 72. In one embodiment as illustrated in FIG. 2A, a low pass filter 52 is applied to the signal before it is routed to the speaker 48 so that the desired audio is provided to the headset wearer. The low pass filter 52 may be a passive filter, or an active filter. Alternatively, the headset may rely solely on a high frequency roll-off response of the speaker 48 to filter out the carrier uplink signal. The low pass filter 52 may also present a sufficiently high impedance to the carrier uplink portion of the composite uplink signal 72 so as to prevent carrier uplink signal power from being dissipated in either the low pass filter 52 or the speaker 48. Advantageously, in cases where the carrier uplink signal is either filtered out by the normal high frequency roll-off of the speaker 48, or is of a sufficiently high frequency so as to be inaudible to the headset wearer, the audio source signal 66 may be heard by persons using older headsets, allowing older headsets to be used with terminals having updated signal multiplexing system terminal software.

In a similar manner as with the audio source signal 66, the carrier uplink signal 68 is separated from the composite uplink signal 72 by a high pass filter 58, which provides a recovered carrier uplink signal 69 to the AC to DC converter 56, and the modulator 54. Converter 56 generates a DC voltage from a portion of the recovered carrier uplink signal 69. The output of converter 56 may then be used to provide power to active components in the headset 14, such as the modulator 54, the filters 52, 58 (if required), acoustic sensors 60, 62, and/or any other headset components that may require power. In that way, power is delivered to an active headset 14 using existing conductors in a headset cable 51 that are dedicated to the audio signal to be played on speaker 48.

Acoustic sensors 60, 62 are configured to capture acoustic energy at the headset 14, such as the voice of the headset user and/or ambient noises, and convert that energy into respective electrical output signals 61, 63. Acoustic sensors may each be microphones that are comprised of one or more condenser elements, electret elements, piezo-electric elements, or any other suitable sensor element that generates an electrical signal in response to acoustic energy. In order that the output signals 61, 63 for respective sensors 60, 62 may be reversibly combined into a single composite downlink signal 76, first acoustic sensor output signal 61 is electrically coupled to modulator 54. Output signal 61 thereby modulates a portion of the recovered carrier uplink signal 69. The first acoustic sensor output signal 61 may be used to vary the amplitude, phase, frequency, and/or any combination of these three signal characteristics, to produce a modulated carrier downlink signal 74 having frequency characteristics such that it may be combined with sensor output signal 63 without the signals 63, 74 interfering with each other.

Modulation may be in the form of amplitude modulation (AM), single sideband AM (SSB), quadrature amplitude modulation (QAM), frequency modulation (FM), phase modulation (PM), or any other type of modulation suitable for conveying information on a carrier signal. In one potential embodiment, the output of the acoustic sensor 60 may be converted into digital form by an ADC 75 in the headset, and the resulting digital signal used to digitally modulate the carrier uplink signal 68. For digital modulation, frequency shift keying (FSK), amplitude shift keying (ASK), phase shift keying (PSK), QAM, minimum shift keying (MSK), or any other type of modulation suitable for conveying digital symbols over a carrier signal may be used. The modulated carrier downlink signal 74 is then combined with the second acoustic sensor signal 63 by the multiplexer circuit 64 to form the composite downlink signal 76, such as by using frequency division multiplexing. The composite downlink signal 76 may be handled over a single conductor of the headset cable 51, such as a single conductor dedicated to handling the microphone signal from the headset 14. The composite downlink signal 76 is then coupled by appropriate headset output contacts 78 to one or more terminal contacts forming the microphone input 80 through the connector interface 28. The connector interface 28 provides suitable coupling between appropriate conductors or signal channels associated with the headset 14 and headset cable 51 and the corresponding contacts and connector inputs/outputs of the terminal 12.

At the terminal 12, the composite downlink signal 76 is converted to a digital composite downlink signal 82 suitable for digital signal processing by the ADC 34, and provided to the SPS section 30 of the terminal 12. A recovered version of the second acoustic sensor output signal 83 is obtained by filtering the digital composite downlink signal 82 with a low pass filter 41. Using the carrier uplink signal 68 provided by the carrier signal source 37, the demodulator 39 demodulates the digital composite downlink signal 82, and the modulator output 84 is filtered by low pass filter 40 to produce a recovered version of the first acoustic sensor output 86. Multiple sensor output signals 61, 63 may thereby be transmitted from the headset 14 to the terminal 12 using a single conductor in cable 51 providing a single physical channel of the connector interface 28.

Advantageously, providing the carrier signal to the headset 14 from the terminal 12 then simplifies the subsequent demodulation at the terminal 12. Because the carrier signal provided to both the modulator 54 and demodulator 39 is generated by the same carrier signal source 37, the need to provide a separate frequency synchronous local oscillator signal to the demodulator 39 is eliminated. More advantageously, because the carrier uplink signal 68 and recovered carrier uplink signal 69 have substantially the same phase, synchronous detection schemes—such as those typically used to demodulate SSB and PM signals—may be used without requiring generation of a separate phase synchronous carrier signal in the terminal.

Figure 2B:
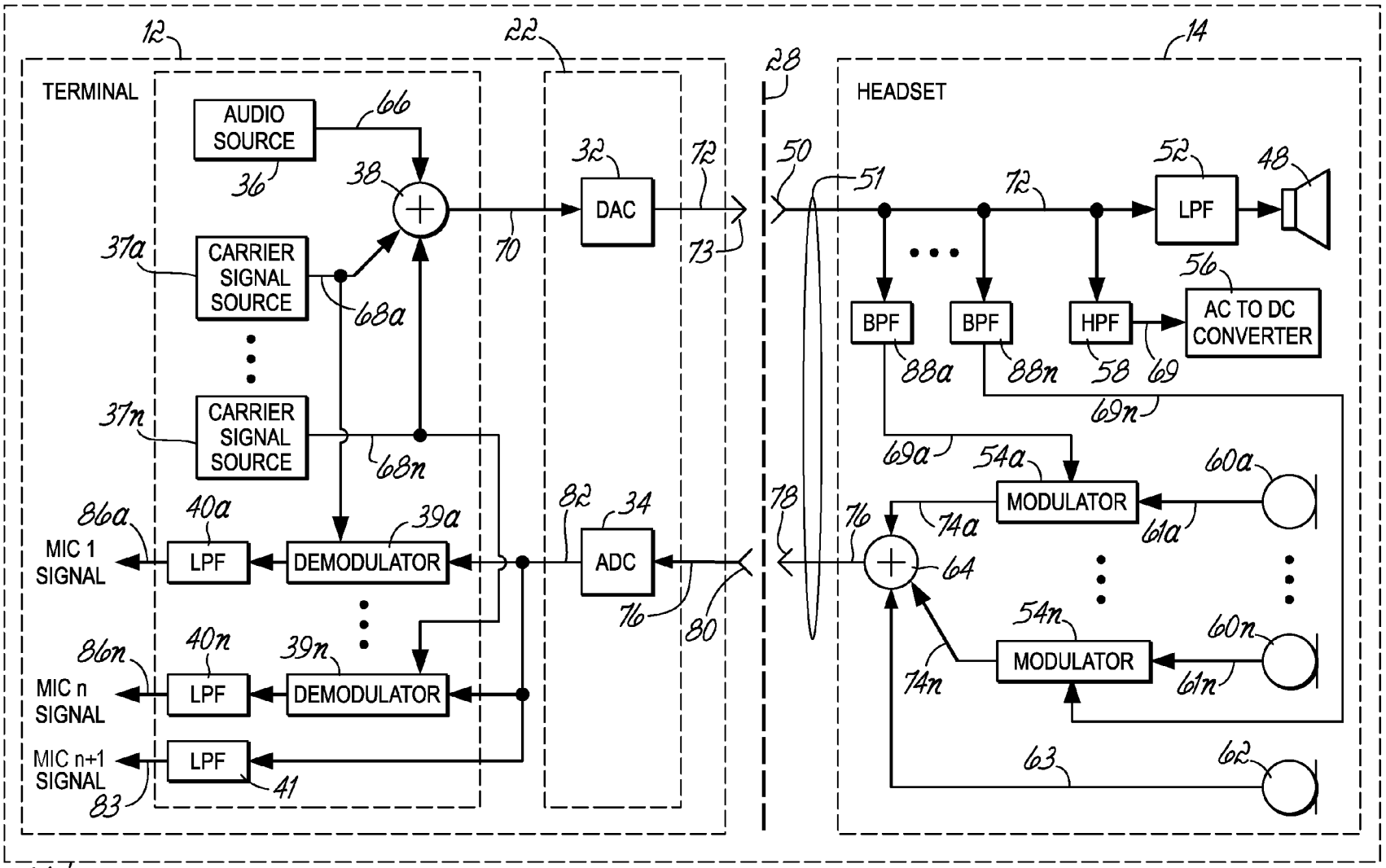
FIG. 2B is a block diagram of the terminal and headset in FIG. 2A employing multiple carrier sources in accordance with an embodiment of the invention.

Referring now to FIG. 2B, in which like reference numbers refer to like features in FIG. 2A, and in accordance with another embodiment of the invention, terminal 12 is shown with the SPS section 30 including a plurality of carrier signal sources 37*a*-37*n*. Each carrier signal source 37*a*-37*n* supplies a carrier uplink signal 68*a*-68*n* having a different frequency so that multiple sensor signals may be multiplexed onto a single cable conductor and appropriate output contact 78. By way of example, in a signal multiplexing system 26 supporting 8 kHz bandwidth sensor output signals 60*a*-60*n*, 63, 12 carrier sources each separated by 16 kHz and modulated using AM could ideally be used to transmit 13 separate sensor output signals 60*a*-60*n*, 63 between the headset 14 and terminal 12 over a total connector interface bandwidth of 200 kHz. In practice, non-ideal filters might require additional spacing between carriers, and consequently additional total bandwidth. As will be understood by persons having ordinary skill in the art, other modulation schemes and/or sensor output bandwidths could be implemented that would result in different numbers of carrier signals and downlink signals.

In a similar manner as described with reference to FIG. 2A, audio source signal 66 is combined with carrier uplink signals 69*a*-69*n* to form composite uplink signal 70, which is converted to analog composite uplink signal 72 and transmitted to headset 14 over connector interface 28 and on a single conductor of the headset cable 51. In the headset, the individual carrier uplink signals 68*a*-68*n* are separated out from the composite uplink signal 72 by appropriate band pass filters 88*a*-88*n* so that recovered carrier uplink signals 69*a*-69*n* are provided to respective modulators 54*a*-54*n*. Band pass filters 88*a*-88*n* may be either passive filters or active filters having sufficient out of band rejection to prevent unacceptable cross-talk between the acoustic sensor output signals 61*a*-61*n* when the modulated carrier downlink signals 74*a*-74*n* are demodulated by the demodulators 39*a*-39*n* in the terminal 12. The modulated carrier output downlink signals 74*a*-74*n* are combined with acoustic sensor output signal 63 by multiplexer circuit 64 to form composite downlink signal 76, which is transmitted to the ADC 34 in the same manner as described with reference to FIG. 2A. Once in the SPS section 30, each modulated carrier downlink signal 74*a*-74*n* is demodulated using its associated carrier uplink signal 68*a*-68*n* and filtered by a low pass filter 40*a*-40*n* to provide a recovered version of respective acoustic sensor output signal 61*a*-61*n*.

Figure 2C:
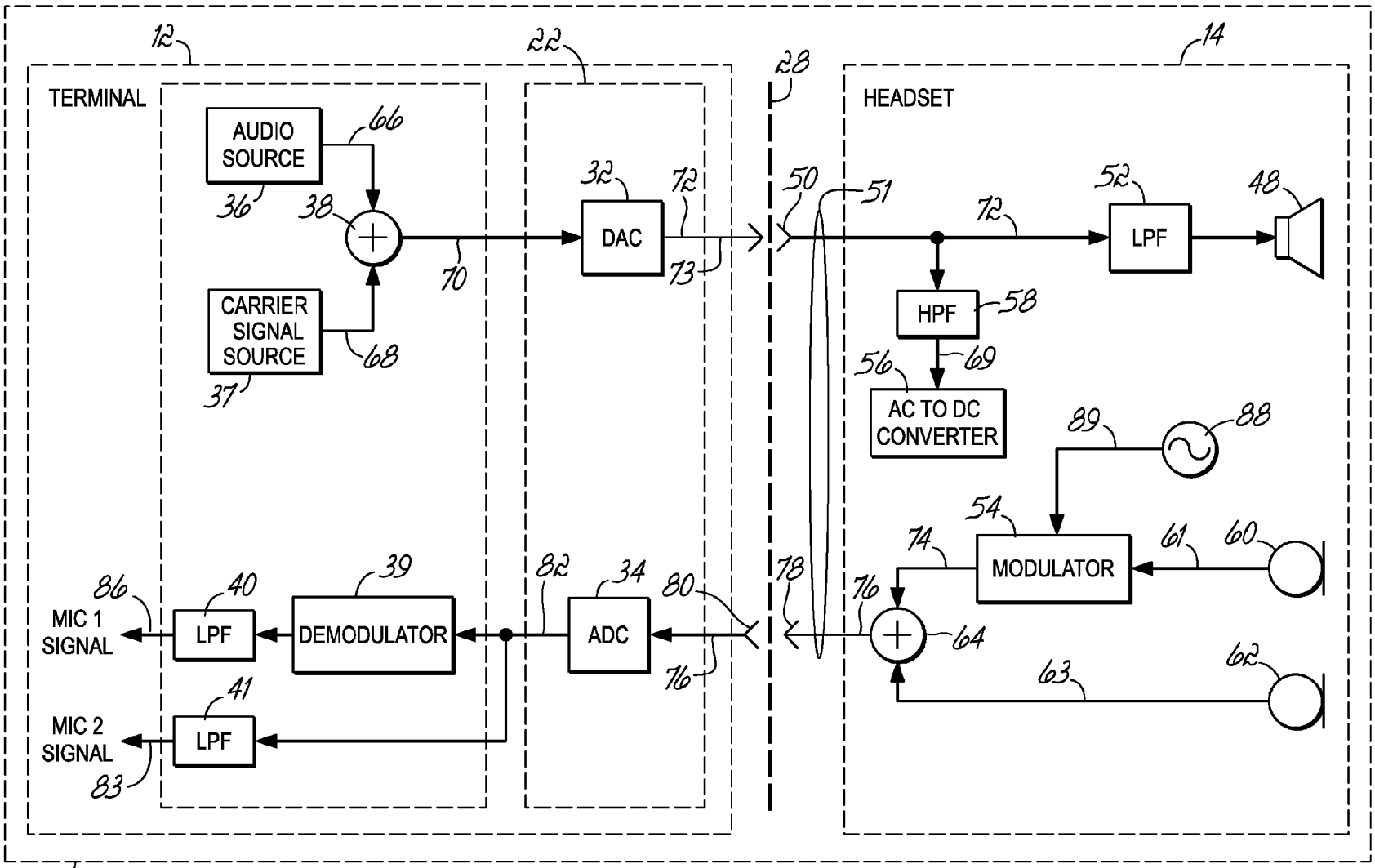
FIG. 2C is a block diagram of the terminal and headset in FIG. 2A illustrating an alternative embodiment of the invention employing a carrier source in the headset.

Referring now to FIG. 2C, in which like reference numbers refer to like features in FIGS. 2A and 2B, and in accordance with another alternative embodiment of the invention, headset 14 is shown with a carrier source 88, which may be an oscillator, such as a voltage controlled oscillator (VCO) controlled by a PLL (not shown), and/or a crystal oscillator. The acoustic sensor output signals 61, 63 are multiplexed together to form composite downlink signal 76 in substantially the same manner as previously described with respect to FIG. 2A, except that the carrier signal 89 is provided to the modulator 54 by carrier source 88 in the headset 14 rather than by the recovered carrier uplink signal 69. Depending on the type of modulation used, demodulator 39 may use a non-synchronous detection method, such as envelope detection, to recover the acoustic sensor output signal 61. Demodulator 39 may also use carrier recovery techniques to perform coherent demodulation of the modulated carrier downlink signal 74. Alternatively, the carrier source 88 may be phase and/or frequency locked with the recovered carrier uplink signal 69 so that its phase is known with respect to the carrier signal source 37 in the terminal.

Figure 3:
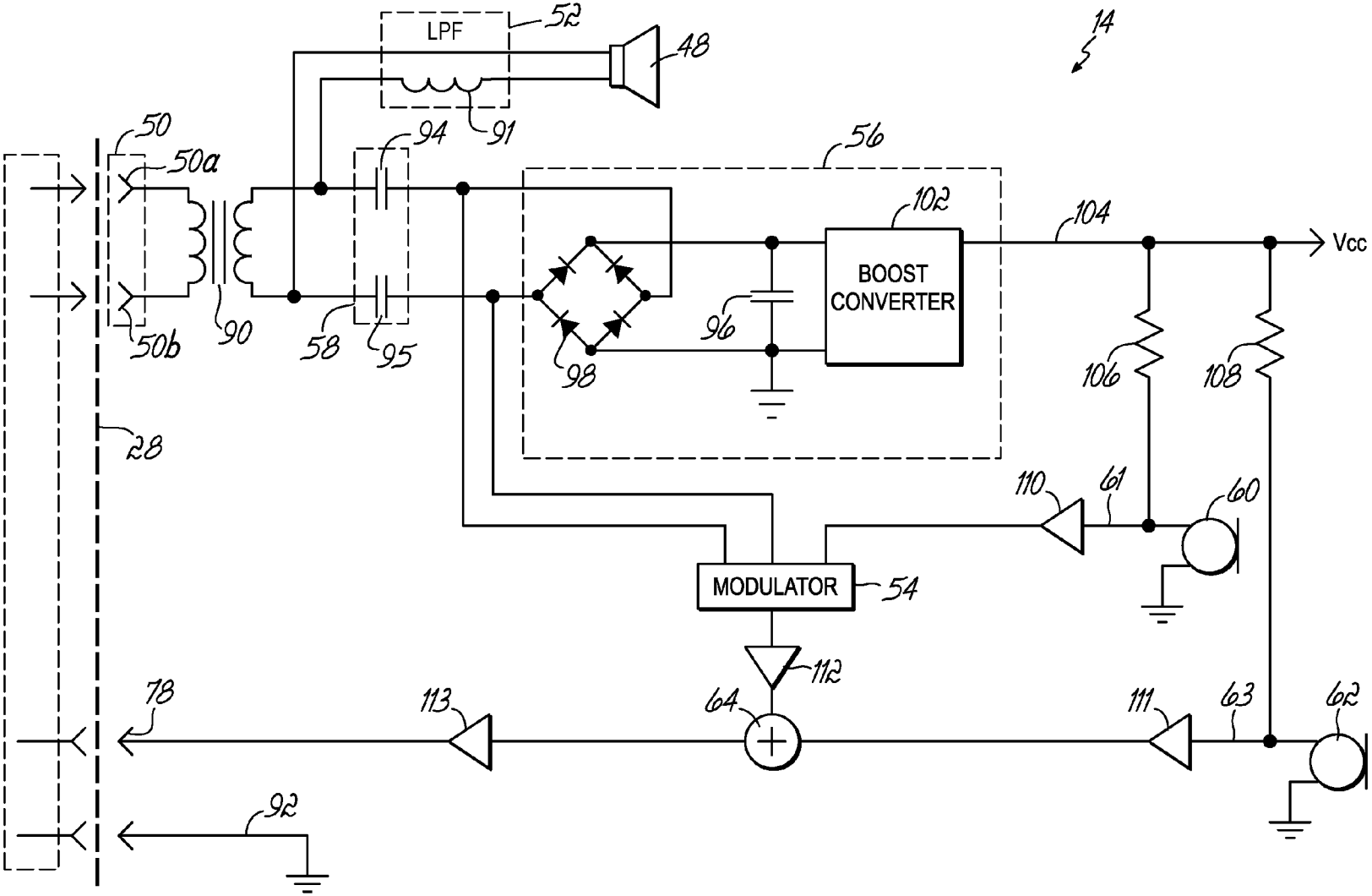
FIG. 3 is a schematic illustrating the headset from FIG. 2A with additional circuit details in accordance with an embodiment of the invention.

Referring now to FIG. 3, in which like reference numbers refer to like features in FIG. 2A, the headset 14 is illustrated showing additional circuit details of an embodiment of the invention. The connector interface 28 is shown including two contacts 50*a*, 50*b* forming input 50. Input 50 may be either a balanced input, such as that produced by a bridged amplifier output, or an unbalanced input, such as if contact 50*a* or 50*b* is the same connection as common ground 92. In either case the headset 14 may include an optional decoupling transformer 90 and/or optional decoupling capacitors 94, 95 to de-reference the input 50 from ground 92. Transformer 90 may also be used to increase the signal voltage from input 50, and may alternatively be positioned after input 50 is routed to the low pass filter 52 or the speaker 48. Signals arriving at input 50 are coupled to the speaker 48 by one or more inductors 91 that serves as a choke, forming the low pass filter 52. Low pass filter may present a high series impedance to carrier components which may be present in the input signals, preventing the carrier components from dissipating power and producing unwanted audio signals in the speaker 48.

Advantageously, the aforementioned configuration allows for terminals 12 to be designed to determine whether the attached headset contains multiple acoustic transducers based on the absence or presence of one or more carrier frequencies in the composite downlink signal 76. Alternatively, the terminal 12 could be configured to detect the presence of a headset identity chip (not shown), which would relay information about the headset back to the terminal 12, such as the number of microphones present in the headset 14 and/or modulation frequencies supported by the headset 14, so that the terminal 12 could adjust its composite uplink signal 72 to be compatible with the attached headset. As a further alternative, the terminal 12 could adjust, or switch off, carrier uplink signal 68 based on the absence or presence of the carrier frequency in the composite downlink signal 76 so as to facilitate compatibility with older headsets.

High pass filter 58 is shown including capacitors 94, 95, and couples the carrier component of the input signals—which may be present on either one or both of the connectors 50*a*, 50*b* comprising headset input 50—to the modulator 54 and the AC to DC converter 56. The AC to DC converter includes a rectifier 98. Although the rectifier 98 is illustrated in FIG. 3 as a full wave rectifier, the rectifier 98 might also be a half-wave rectifier if input 50 is unbalanced and/or can provide enough power without full-wave rectification. The carrier component signal is passed through the rectifier 98 to produce an output voltage having a DC component, which charges a capacitor 96 to provide a power reservoir. The AC to DC converter 56 may also include a boost converter 102 to increase the voltage output, so that the AC to DC converter provides an output voltage 104 (VCC) at a level sufficient to power the active components of the headset 14.

Depending on the type of sensor employed, acoustic sensors 60, 62 may be provided with a bias voltage through resistors 106, 108. Optional buffer amplifiers 110, 111 may be used to couple the acoustic sensor output signals 61, 63 to the modulator 54 and multiplexer circuit 64 respectively, providing signal isolation to the acoustic sensors 60, 62. Additional buffer amplifiers 112, 113 may be used to couple the modulator output to the multiplexer circuit 64, providing additional signal isolation, and to buffer the output of the multiplexer circuit 64.

Advantageously, through the use of frequency multiplexing, the headset signal multiplexing system allows the use of multiple acoustic sensors in a headset without increasing the number of conductors required in the terminal/headset interface. More advantageously, by supplying each individual acoustic sensor output signal to the terminal instead of processing them in the headset, speech recognition algorithms in the terminal may be configured to use spatial information contained in the multiple signals to improve speech recognition performance above what can be obtained with a single pre-processed signal. Further, by moving signal processing functions from the headset to the terminal, the cost of the terminal/headset combination may be reduced by removing signal processing electronics from the headset and taking advantage of the excess processing power available in the terminal. Still further advantages are provided by sourcing the carrier signals from the terminal. In addition to facilitating demodulation of the downlink signals from the headset, the carrier uplink signals also provide a convenient power source to the headset that does not require replacing batteries or adding additional interface conductors.

While the invention has been illustrated by a description of various embodiments, and while these embodiments have been described in considerable detail, it is not the intention of the applicant to restrict or in any way limit the scope of the appended claims to such detail. Additional advantages and modifications will readily appear to those skilled in the art. For example, a band pass filter can be used in place of any high pass or low pass filter as described in this document. As another example, additional downlink carrier signals could be generated in the headset at integer multiples of the uplink carrier signal by using a frequency multiplier. As yet another example, the uplink carrier could be used as a reference to allow one or more phased locked loops (PLLs) in the headset to generate additional carriers that are phase synchronous with the uplink carrier. The invention in its broader aspects is therefore not limited to the specific details, representative methods, and illustrative examples shown and described. Accordingly, departures may be made from such details without departing from the spirit or scope of applicant's general inventive concept.

The invention claimed is:

1. A device, comprising:

a headset;

a first acoustic sensor on the headset having an output signal;

a second acoustic sensor on the headset having an output signal;

modulator circuitry configured for:

receiving (i) a carrier signal and (ii) the output signal of the second acoustic sensor; and modulating the received carrier signal with the received output signal of the second acoustic sensor to generate a modulated output signal reflective of the output signal of the second acoustic sensor;

combining circuitry configured for:

receiving (i) the output signal of the first acoustic sensor and (ii) the modulated output signal; and combining the output signal of the first acoustic sensor and the modulated output signal to generate a composite downlink signal for transmission over a common conductor; and first and second electrical connections configured for providing a connection to a terminal device;

wherein at least one of the first and second electrical connections is coupled with the combining circuitry for directing the composite downlink signal to the terminal device.

2. The device of claim 1, comprising an AC to DC converter coupled to receive a carrier signal, the AC to DC converter configured for converting a portion of a carrier signal into a power signal to supply power to the device.

3. The device of claim 1, wherein at least one of the electrical connections is configured for handling a carrier signal provided to the device from a terminal device coupled to the device.

4. The device of claim 3, wherein the modulator circuitry is configured for receiving the carrier signal from the terminal device.

5. The device of claim 1, comprising a connector interface comprising the first and second electrical connections, wherein at least one of the first and second electrical connections is configured for handling an uplink signal from a terminal device including an audio signal and the carrier signal.

6. The device of claim 5, comprising a speaker electrically coupled to the electrical connection handling the uplink signal, the speaker operable for playing the audio signal.

7. The device of claim 6, comprising a filter coupled between the connector interface and the speaker for blocking the carrier signal from the speaker and passing the audio signal to be played by the speaker.

8. The device of claim 1, comprising a third acoustic sensor having an output signal, wherein:

the modulator circuitry is configured for:

receiving the output signal of the third acoustic sensor; and modulating the received carrier signal with the received output signal of the third acoustic sensor to generate an additional modulated output signal; and the combining circuitry is configured for:

receiving the additional modulated output signal; and combining the additional modulated output signal with the output signal of the first acoustic sensor and the modulated output signal to generate the composite downlink signal.

9. A system, comprising:

a terminal device configured for generating an uplink signal having a audio signal and a carrier signal;

a headset configured for generating a downlink signal, the headset comprising a first acoustic sensor having an output signal and a second acoustic sensor having an output signal;

a connector interface coupled between the terminal device and the headset and comprising a first electrical connection and a second electrical connection for directing the uplink signal and the downlink signal between the headset and the terminal device;

modulator circuitry configured for:

receiving (i) a carrier signal and (ii) the output signal of the second acoustic sensor; and modulating the received carrier signal with the received output signal of the second acoustic sensor to generate a modulated output signal reflective of the output signal of the second acoustic sensor; and combining circuitry configured for:

receiving (i) the output signal of the first acoustic sensor and (ii) the modulated output signal; and combining the output signal of the first acoustic sensor and the modulated output signal to generate the downlink signal for transmission over the first electrical connection and/or the second electrical connection.

10. The system of claim 9, wherein:

the modulator circuitry is coupled to the connector interface; and the modulator circuitry is configured for using the carrier signal of the uplink signal for modulating the carrier signal.

11. The system of claim 9, wherein the terminal device comprises:

a signal source for generating the carrier signal;

an audio signal source for generating the audio signal; and a signal combining circuit for combining the audio signal and carrier signal to form the uplink signal.

12. The system of claim 9, wherein:

the audio signal and the carrier signal are digital signals; and the terminal device comprises a digital-to-analog converter for forming an analog uplink signal.

13. The system of claim 9, wherein the terminal device comprises a demodulator for demodulating the downlink signal and extracting the output signals of the first and second acoustic sensors.

14. The system of claim 9, wherein the headset comprises a signal source for generating a carrier signal in the headset, the signal source coupled with the modulator circuitry for modulating the carrier signal.

15. The system of claim 9, wherein the headset comprises:

a speaker electrically coupled to the first electrical connection and/or the second electrical connection; and a first filter coupled between the connector interface and the speaker, the first filter configured for blocking the carrier signal from the speaker and passing the audio signal to be played by the speaker.

16. A method, comprising:

summing, at a terminal device, an audio signal and a carrier signal to generate an uplink signal;

transmitting the uplink signal to a headset;

filtering, at the headset, the uplink signal to extract the carrier signal;

generating output signals with a first acoustic sensor and a second acoustic sensor;

modulating the carrier signal with the output signal of the second acoustic sensor to generate a modulated output signal reflective of the output signal of the second acoustic sensor;

combining the modulated output signal and the output signal of the first acoustic sensor to produce a composite downlink signal; and transmitting the composite downlink signal to the terminal device.

17. The method of claim 16, comprising:

filtering the uplink signal to extract the audio signal; and playing the audio signal at the headset with a speaker.

18. The method of claim 16, comprising demodulating the composite downlink signal at the terminal device using the carrier signal.

19. The method of claim 16, comprising using a carrier signal in the headset to generate a power signal.

20. The method of claim 16, comprising:

generating output signals with a third acoustic sensor;

modulating the carrier signal with the output signal of the third acoustic sensor to generate an additional modulated output signal; and combining the additional modulated output signal with the output signal of the first acoustic sensor and the modulated output signal to generate the composite downlink signal.

* * * * *